United States Patent [19]

Ruenzi

[11] 4,179,115

[45] Dec. 18, 1979

[54] SHEET FEEDING AND COLLATING APPARATUS

[76] Inventor: Kurt Ruenzi, Kuesnachterstrasse 59, Zumikon, Switzerland, 8126

[21] Appl. No.: 848,899

[22] Filed: Nov. 7, 1977

Related U.S. Application Data

[63] Continuation-in-part of Ser. No. 674,917, Apr. 8, 1976, abandoned.

[30] Foreign Application Priority Data

Apr. 15, 1975 [CH] Switzerland ..... 4759/75

[51] Int. Cl.[2] ..... B65H 29/60; B65H 31/24

[52] U.S. Cl. ..... 271/297; 271/198; 271/273

[58] Field of Search ..... 271/173, 64, 198, 200, 271/272, 273, 274, 275; 270/58

[56] References Cited

U.S. PATENT DOCUMENTS

| | | | |
|---|---|---|---|
| 1,864,075 | 6/1932 | Lasker | 271/64 X |
| 2,492,386 | 12/1949 | Little | 271/173 |
| 3,084,932 | 4/1963 | Schiller et al. | 271/186 |
| 3,128,093 | 4/1964 | Highsmith et al. | 271/64 |
| 3,239,214 | 3/1966 | Rauschenburger | 271/273 |
| 3,580,563 | 5/1971 | Bassett | 271/173 X |
| 3,709,492 | 1/1973 | Baker et al. | 271/173 |
| 3,744,790 | 7/1973 | Hoffman | 271/173 |
| 3,944,217 | 3/1976 | Greene et al. | 271/173 |
| 3,951,402 | 4/1976 | Skinner | 271/273 |

*Primary Examiner*—Bruce H. Stoner, Jr.

*Attorney, Agent, or Firm*—W. G. Fasse; D. F. Gould

[57] ABSTRACT

This sheet feeding and collating apparatus has a frame supporting a plurality of upwardly open collating compartments arranged in a row and slanting relative to the vertical. The frame also supports a sheet input feeder as well as a sheet transport and guide mechanism located above the collating compartments so that a sheet advancing roller is substantially aligned with an upper edge of each compartment. At least one tiltable guide gate is located above each compartment. The gates are sequentially operable by respective magnets in response to the movement of a sheet through a light beam to sequentially deflect the sheets into respective compartments. Each interruption of the light beam actuates a stepping switch which in turn connects the operating magnets sequentially to their respective energizing circuit. When the last compartment in a sequence has received a sheet, the stepping switch is reset to begin a new sequence in a ring around fashion. The sheet input feeder is capable of receiving sheets, for example, from a copier or printer, and to supply these sheets into the collator.

20 Claims, 12 Drawing Figures

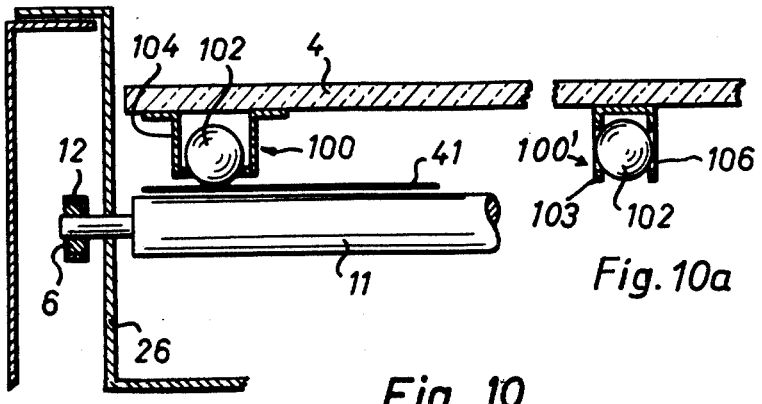
Fig. 10a
Fig. 10
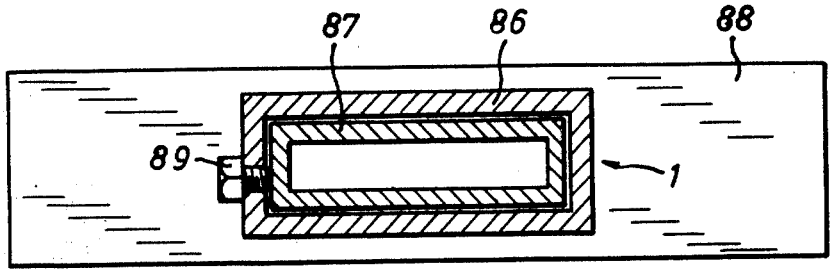
Fig. 11

SHEET FEEDING AND COLLATING APPARATUS

BACKGROUND OF THE INVENTION

This is a continuation-in-part application of my copending application Ser. No. 674,917; filed Apr. 8, 1976, now abandoned.

The present invention relates to a sheet feeding and collating apparatus, especially sheets of paper or the like to be sequentially placed into a plurality of collating compartments. Sheet deflecting gates are arranged for cooperation with the respective compartments and these gates are selectively tiltable in order to deflect the advancing sheets into the compartments in sequence. The input end of the collator cooperates with a sheet feeder.

Such devices are used for collating sheets of paper, for example, issuing from a printing press or a copier in order to form stacks of such sheets of paper, whereby the sheets in each stack must be arranged in a desired sequence, for example, a page sequence. Prior art devices for this purpose are rather complicated and respectively expensive

OBJECTS OF THE INVENTION

In view of the foregoing, it is the aim of the invention to achieve the following objects singly or in combination:

- to provide a collating apparatus which is especially simple in its structure and hence reliable in its operation to provide a substantially trouble-free and hence maintenance free operation;
- to construct a collating apparatus in such a manner that a minimum of structural elements are required, which are easily assembled;
- to provide a collating apparatus which in spite of its simplicity operates rapidly and reliably;
- to provide a sheet input feeder which can act as an interface, so to speak, between the present collator and a plurality of different sheet handling devices;
- to construct a sheet input feeder which is adjustable in its input height; and
- to provide sheet hold down means which minimize the friction between the hold down means and the sheet.

SUMMARY OF THE INVENTION

According to the invention there is provided a collating apparatus for sheet material, especially sheets of paper or the like wherein a plurality of collating compartments cooperate with sheet deflecting guide gates which are selectively and hence sequentially tiltable into a sheet deflecting position from a sheet passing position. The sequential tilting of the sheet deflecting guide gates is accomplished by means of a light barrier including a photocell and a light source arranged below the deflecting guide gates in such a manner that one light barrier may cooperate with all the deflecting gates in sequence. Each deflecting gate is provided with an electromagnet for tilting the gate under the control of the light barrier.

According to the invention there is further provided a sheet input feeder hinged to the collator at one end by a horizontal hinging axis so that the opposite free end of the feeder is adjustable up and down. The feeder comprises a plurality of transport belts which are positively driven.

BRIEF FIGURE DESCRIPTION

In order that the invention may be clearly understood, it will now be described, by way of example, with reference to the accompanying drawings, wherein:

FIG. 1—is a perspective overall view of the apparatus according to the invention;

FIG. 2—is a top plan view of the present apparatus;

FIG. 3—illustrates a side view of the present collating apparatus;

FIG. 4—shows a perspective illustration of the arrangement of the sheet deflecting gates, the electromagnets for the gates and the transport rollers for the sheets to be collated;

FIG. 5—is a sectional view through the upper portion of the apparatus;

FIG. 6—is a side view partially in section illustrating one compartment with its gate in the closed position and a further compartment with the gate in the sheet deflecting position;

FIG. 7—is a simplified illustration of a circuit arrangement for sequentially operating the sheet deflecting gates;

FIG. 8—shows the left hand end of the collator in a side view similar to FIG. 3 but including a sectional view of the sheet feeder;

FIG. 9—is a top plan view of the sheet feeder of FIG. 8;

FIG. 10—shows a sectional view through a sheet hold down member with bearing balls;

FIG. 10*a*—illustrates a sectional view through a modified sheet hold down member; and FIG. 11—is a sectional view through a support leg along section line 11—11 in FIG. 8.

DETAILED DESCRIPTION OF PREFERRED EXAMPLE EMBODIMENTS

Figure 1:
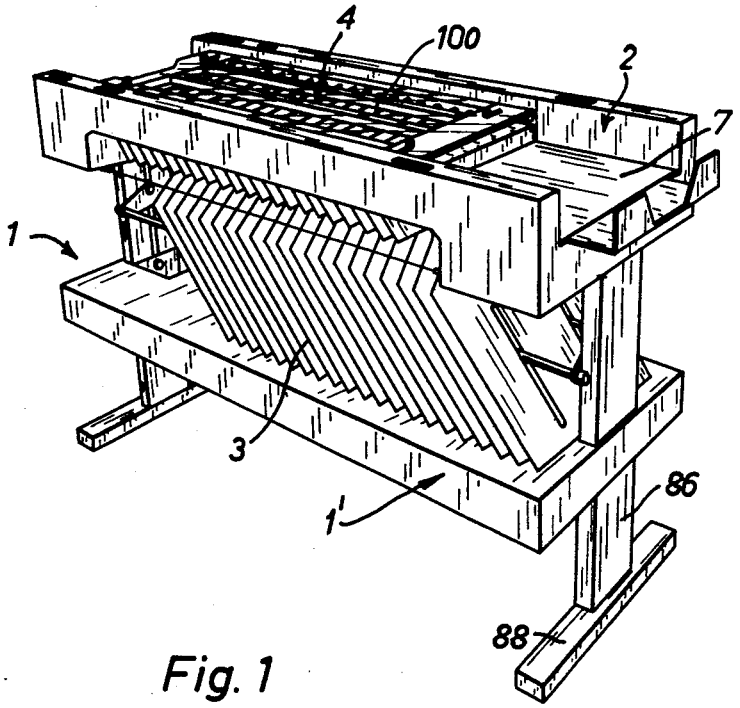
Figure 2:
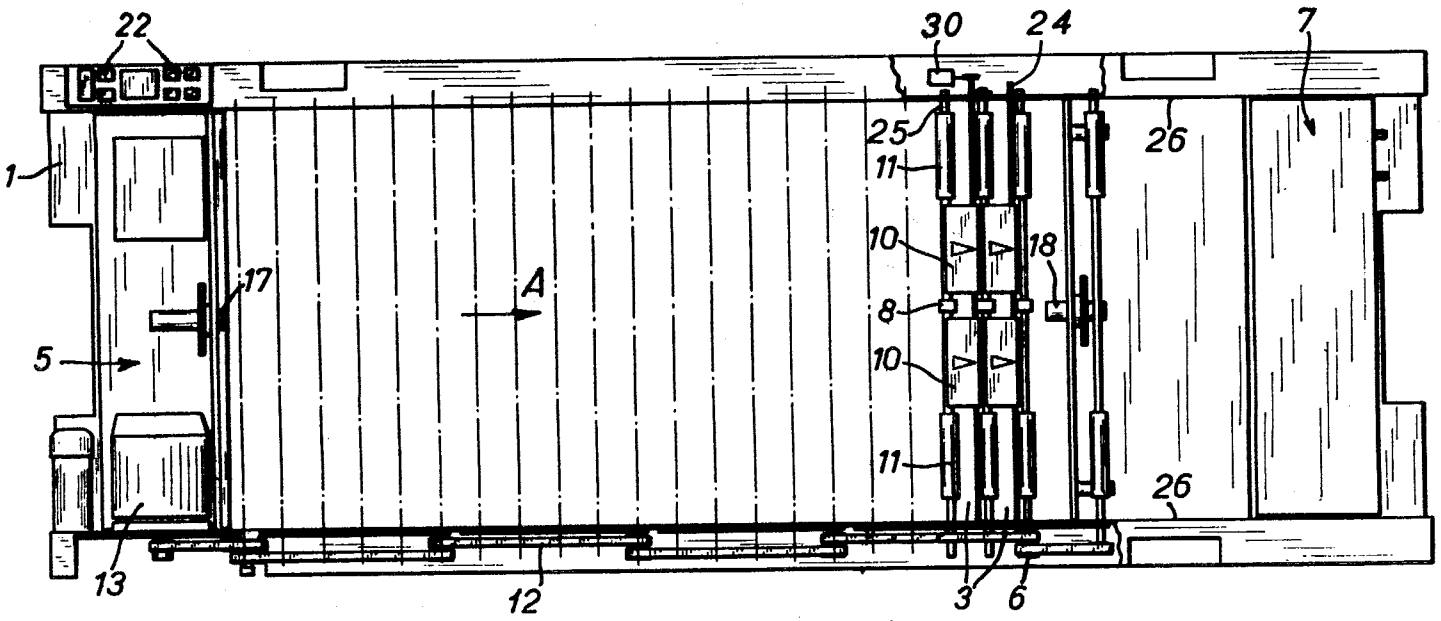
Figure 3:
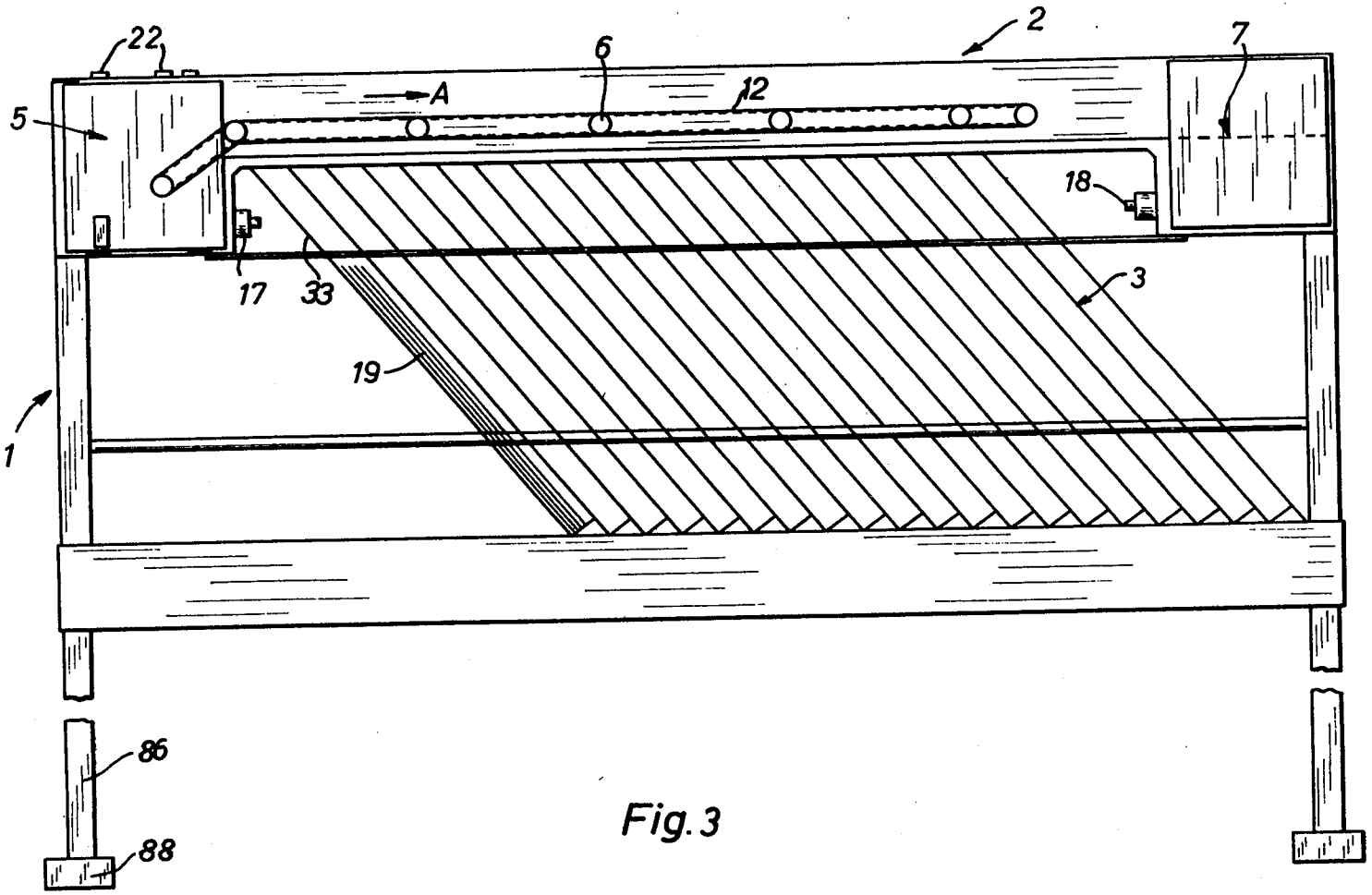
Figure 4:
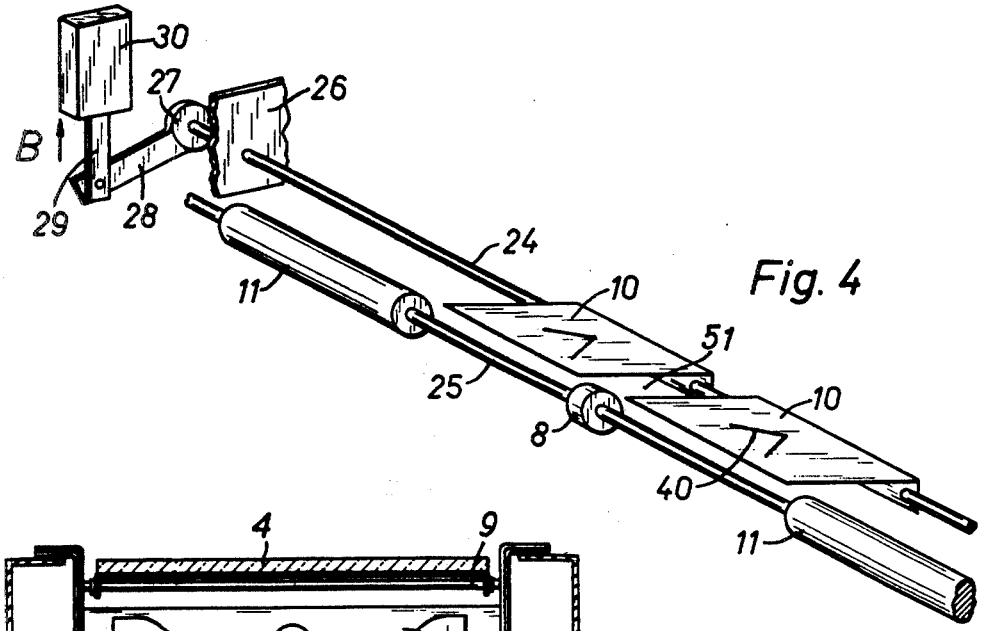
Figure 5:
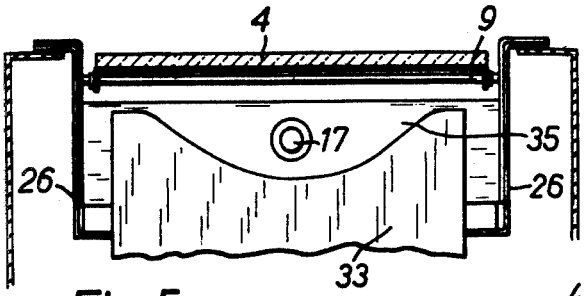

Referring to FIG. 1 the present collating apparatus comprises a frame structure 1 including a lower supporting table 1' and a top member 2, which is removably supported above the table 1' by upright posts. The table 1' supports a plurality of collating compartments 3. For practical purposes there may be provided about twenty collating compartments 3, which receive the sheets to be collated. The removable top member 2 comprises a cover 4 tiltable about a horizontal axis 9 as best seen in FIG. 5. Preferably, the cover 4 is at least partially made of transparent material. The tilting axis 9 of the cover 4 is supported in the side walls 26 of the top member 2 which also supports a transport mechanism for the sheets to be collated as best seen in FIGS. 2 and 3. The transport mechanism may comprise a plurality of spaced rollers 8 and 11, as best seen in FIG. 4. The sheet advance mechanism may also include at least one endless transport belt, for example, at the inlet end of the apparatus. Referring to FIG. 2 a motor 13 is operatively connected through belts or chains 12 driving pulleys or pinions 6 which rotate the shafts 25 on which the feed advance rollers 8 and 11 are supported, as will be described in more detail below.

As shown in the plan view of FIG. 2, each collating compartment 3 is arranged for cooperation with at least one, preferably two, sheet deflecting gates 10. These gates 10 are rigidly secured along one edge thereof to a tilting shaft 24. In other words, there are as many tilting shafts 24 as there are collating compartments 3 and each shaft is operable or rather, rotatable through a predetermined angular movement independently of any of the other tilting shafts 24. The shafts 24 are also tiltably supported at both ends in the side walls 26 of the top member, as best seen in FIG. 4. The gates 10 thus may take up a substantially horizontal position as shown in FIG. 4 in which the plane of the gates is somewhat below the plane defined by the surfaces of the rollers 8, 11, and a tilted position wherein the free edge of any gate reaches upwardly above the plane defined by the rollers 8 and 11, as best seen at 10' in FIG. 6. In the left-hand side of FIG. 6 the gate 10 is closed, whereas in the right-hand side the gate 10' is in the upwardly titlted position to deflect a sheet 41 onto the stack 19.

Figure 7:
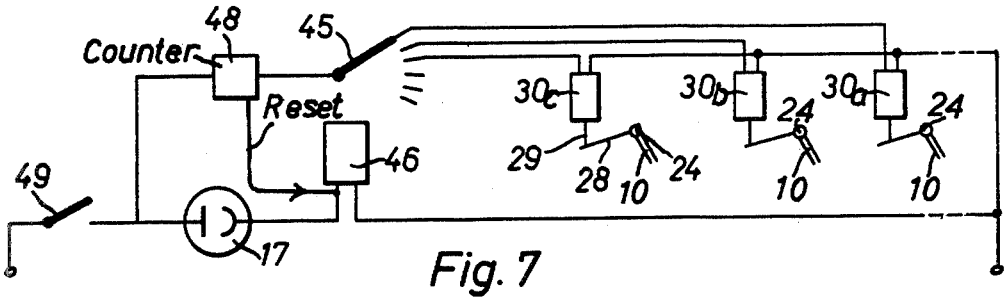

The deflecting gates 10 are operated by means of respective magnets 30 as shown in FIGS. 4 and 7. The circuit arrangment of FIG. 7 is such that at any one instant only one gate 10 will be in the open position 10' whereas all other gates will be in the closed position. As soon as a sheet 41 is located in the respective compartment, the gate will be closed and the next succeeding gate will be opened.

The compartments 3 are formed by slanted walls 33 of sheet metal. Each wall is provided at its upper edge with a cut-out 35, as best seen in FIG. 5. A light barrier extends from the light source 18 through all the cut-outs 35 to the photocell 17. The photocell 17 in turn is connected to an energizing circuit for the magnets 30, including a stepping magnet 46, which sequentially operates a stepping switch 45 shown in FIG. 7. Thus, in operation, any sheet 41 interrupts the light barrier when the sheet 41 is deflected by an open gate 10 into the collating compartment 3, whereby the photocell 7 provides an electrical pulse for the stepping magnet 46 provided the on-off switch 49 is in its closed position.

The sheets to be collated are supplied to a feed-in location 5 shown in FIG. 2. The transport rollers 8, 11 move the sheets in the direction of the arrow A until the leading edge of a sheet runs against a gate 10 in its deflecting, upward position. The transport rollers 8, 11 are preferably cylindrical rubber rollers and it is preferable that the rollers 8 and 11 have different lengths so as to provide gaps between adjacent rollers on the same axle 25. The gates 10 are preferably located in register with these gaps as best seen in FIG. 4. As mentioned above, all the shafts 25 are driven in unison by the motor 13 through power transmission means 6, 12. Preferably, the pulleys, or pinions 6 are arranged outwardly of the side walls 26 forming an inner casing for the upper member 2 of the apparatus. Preferably, the transmission means 12 comprise gear belts or V-belts or the like.

As best seen in FIG. 4 the gates 10 normally close the compartments 3 by taking up a position somewhat below the rollers 8 and 11. Each shaft 24 supporting one or more gates 10 is supported at both ends in the side walls 26. A lever 28 is rigidly connected to each shaft 24, for example, through a rigid disc 27 so that the lever arms 28 extend substantially radially away from the respective shaft 24. The other end of the lever 28 is journaled or pivoted to a magnet armature 29, which is movable in the direction of the arrow B when the respective magnet 30 is energized. The upward movement of the armature 29 tilts the lever 28 and thus the respective shaft 24 as well as the respective gates 10, whereby the free edges of the gates 10 take up a position somewhat above the horizontal transport plane defined by the rollers 8 and 11.

Figure 6:
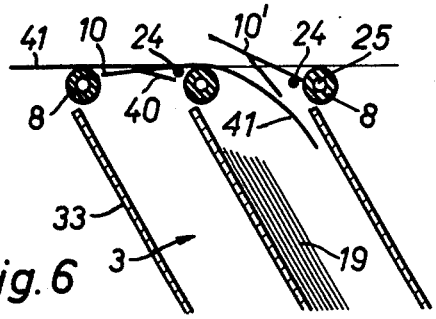

Each deflecting gate 10 is provided with a guide finger 40,which may be simply cut out and bent out of the sheet material, such as sheet metal of which the gates 10 are made. FIG. 6 shows how the guide fingers 40 guide the sheets 41 into the respective compartment thus preventing a sheet from moving into the wrong compartment.

The circuit according to FIG. 7 operates as follows. The switch 49 connecting the control circuit with the photocell 17 to power supply terminals is closed by operating a button 22 on the control panel as shown in FIG. 2. Simultaneously, a motor 13 is also energized and the photocell 17 is thus in stand-by operation. A switching and counting mechanism such as a ring counter 48 is connected in series with the stepping switch 45, which is shown in a starting position, whereby the magnet 30*a* is energized. In other words, initially the first magnet 30*a* is energized without the operation of the photocell 17. The output 48+ of the switching counter 48 represents a plurality of outputs depending on the number of stages. Depending on the arrangement of the magnets, the first gate as viewed in the direction of the arrow A in FIG. 2 or the last gate may be raised first. Thereafter, the gates are raised sequentially by the interruption of the light barrier by each sheet moving into its respective compartment. Thus, each time the light barrier is interrupted, the photocell closes an energizing circuit for the stepping magnet 46, which in turn steps the stepping switch 45 for one step thus energizing the magnets 30*b*, 30*c* and so forth in a sequential order. The number of steps to be performed by the stepping switch 45 corresponds to the number of collating compartments, and thus also to the number of electromagnets 30. Only three magnets and stepping positions are shown in FIG. 7. However, the arrangement may comprise any desired number of magnets and compartments.

As the photocell responds to a sheet 41 moving into the respective collating compartment 3, the stepping magnet 46 will advance the stepping switch 45 until a sequence is completed. Thereafter, the switching counter, such as a ring counter 48 will issue a reset impulse to the stepping magnet 46, thus returning the stepping switch 45 into the starting position shown. The electromechanical stepping mechanism 45, 46 may be replaced by electronic counter means which will also provide pulses for the energization of the magnets 30*a*, 30*b* and so forth. Thus, the moving of a falling sheet 41 into the respective compartment controls the sequential operation of the deflecting gates 10 without requiring any mechanical synchronization between the feed advance on the one hand and the movement of the gates 10. In other words, the feed advance may be continuous and the gate operation is sequential. Preferably, the operation is such that the operation of the magnets 30 is effected in response to the trailing edge of a sheet 41 passing through the light barrier. Controlling the gates by the trailing edge of a sheet and not by the leading edge of the sheet 41 had the advantage that sheets following each other cannot interfere with the proper sequential order of operation. The counter 48 may be adjustable to a predetermined count in order to select the number of stacks to be formed by the sheets 41. When the counter 48 reaches the selected number, a reset impulse will be transmitted to the stepping magnets 46 as described and a new sequence may be started, thus it is not necessary that all compartments should be filled.

The stack 19 may be removed by hand from the compartments 3. For this purpose the compartments 3 are laterally open.

The feature that the cover 4 is tiltable and transparent has the advantage that the moving sheets may be observed. In addition, the gates 10 and their operating mechanisms are easily accessible by lifting the cover 4 so that any sheets that might get stuck, can be easily removed.

The top member 2 may be provided at its downstream end with a file compartment 7.

Figure 8:
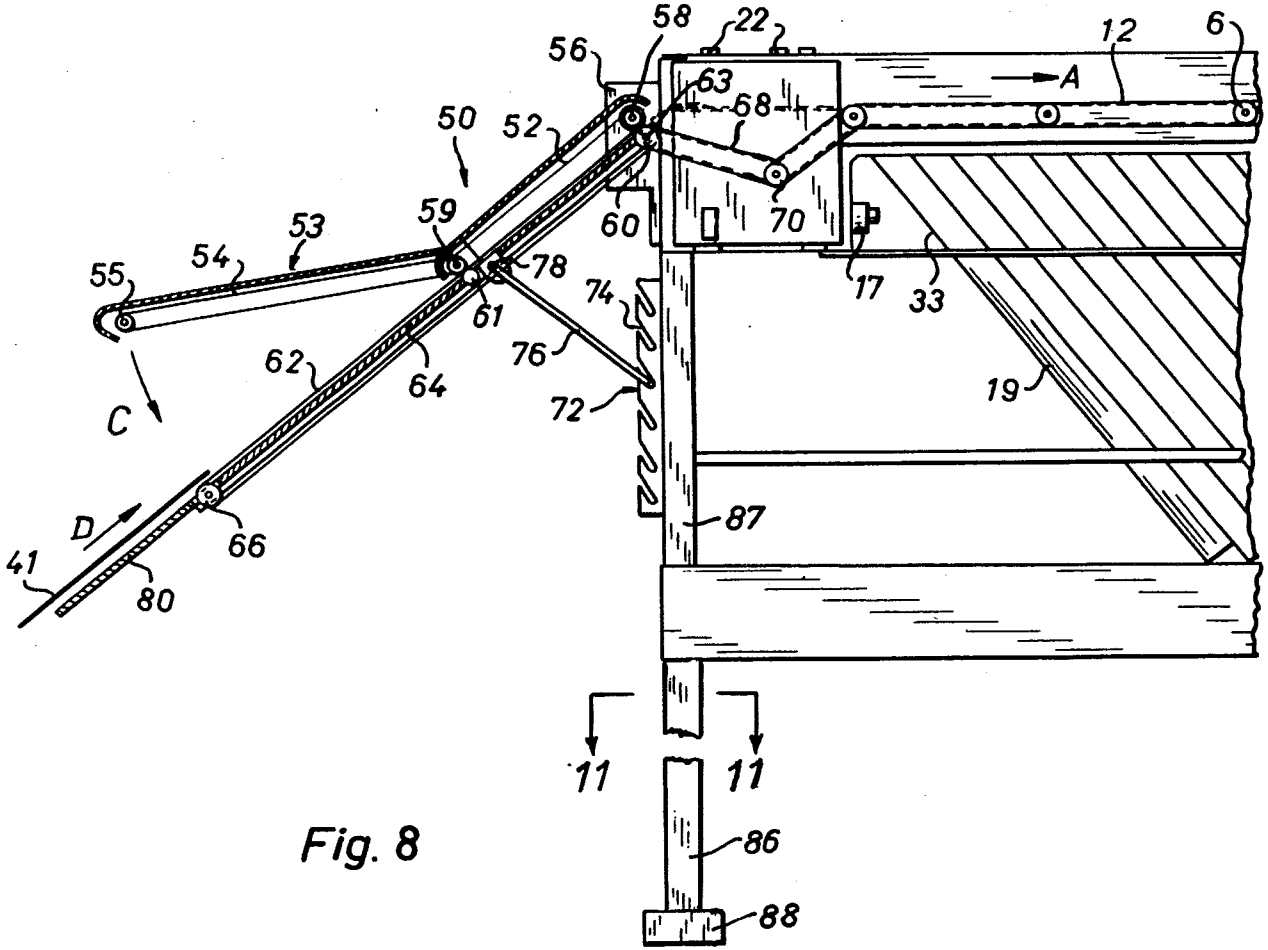

According to the invention the apparatus of FIG. 1 is equipped with a sheet feed-in device 50 shown in detail in FIG. 8. The sheet feed-in device 50 receives the sheets, for example, from a copying machine or from a printing machine and advances the sheets into the collating apparatus. FIG. 8 shows only the left-hand end of the collating apparatus shown in more detail in FIG. 1, for example. Copying and printing machines, especially if made by different manufacturers, have their sheet output slots located at different elevations. Thus, in order to use a collating apparatus of the invention with as many sheet output devices as possible, it is desirable to provide an interface, so to speak, between the output of a sheet supplying device and the input of the present collating apparatus. For this purpose, the sheet feed-in device 50 of the invention is constructed so that it can easily adapt to form a transition between different elevations of sheet output and sheet input.

For the foregoing purpose, the sheet feed-in device 50 is secured to the front or input side of the collating apparatus by means of a holding device 56 secured, for example, by screws or the like to the frame structure of the collating apparatus. The present feed-in device 50 is adjustable to different angular positions as will be explained in more detail below. The device 50 comprises a plurality of driven conveyor means, for example, endless conveyor belts which transport the sheets 41 from a machine not shown into the collator. For this purpose the device 50 includes a platform 64 carrying guide rollers 66, support rollers 61, and drive rollers 60 for the conveyor belts 62. Two or three of such endless conveyor belts 62 may run around the platform 64. A plurality of support rollers 61 may be employed. However, FIG. 8 only illustrates one such support roller 61 to facilitate the illustration.

The drive roller 60 which simultaneously operates as a guide roller is positively driven by a gear belt 68 running at the same speed as the gear belt 12 which drives the transport rollers 11 in the collating apparatus. To this end the gear belt 68 is driven by the same drive roller 70 as the gear belt 12.

The upper end of the platform 64 is hinged to the securing bracket 56 about the axis 63 which also supports the guide and drive roller 60.

The angular position of the platform 64 relative to the vertical frame member 87 of the collating apparatus may be adjusted by means of a rod 76, one end of which is pivotally connected to bracket 78 secured to the platform 64. The other end of the rod 76 fits removably into notches 74 in a notched bracket 72 secured to the upright frame member 87. By placing the lower end of the rod 76 into any one of the notches 74, it is possible to adjust the elevational position of the input end 80 of the feed-in device 50 to receive sheets 41 from sheet output slots which may be located at respective different elevations. The conveyor belt 62 advances the sheet 41 in the direction of the arrow D. Incidentally, at least one rod 76 will be used, preferably, two rods should be employed.

The sheet feed-in device 50 further comprises second transport conveyor means 52 and 54 for the feed advance of the sheets 41. These further conveyor belts 52, 54 are located above the platform 64. The conveyor belt 52 runs about guide wheels or rollers 58, 59, whereby the guide wheel 58 is operatively connected to the guide roller 60 for rotation either by a friction contact, or through other transmission means, for example, gear wheels. The transport belt 54 is driven by means of the guide roller or wheel 59 with the same speed as the transport belt 62.

The belt 54 may be covered by a hood 53 which is tiltable about the axis of the guide roller 59. FIG. 8 illustrates the upper position of the belt 54 and cover hood 53 which is tiltable in the direction of the Arrow C toward the platform 64. In order to transport sheets 41 in the direction of the arrow D the tiltable hood 53 and conveyor belt 54 are moved toward the platform in the direction of the arrow C to such an extent that two or three transport belts contact the sheets 41 for moving these sheets. The platform 64 has a lower portion 80, for example, in the form of an extendable slide. Thus, the platform may be adapted to individual requirements, depending on the particular type of sheet supply apparatus by extending or retracting the lower end 80 of the platform. The feature, that the upper portion of the sheet feed-in device with the hood 53 can be lifted, has the advantage that any tangled sheet is easily removable since lifting the hood 53 provides access.

Figure 9:
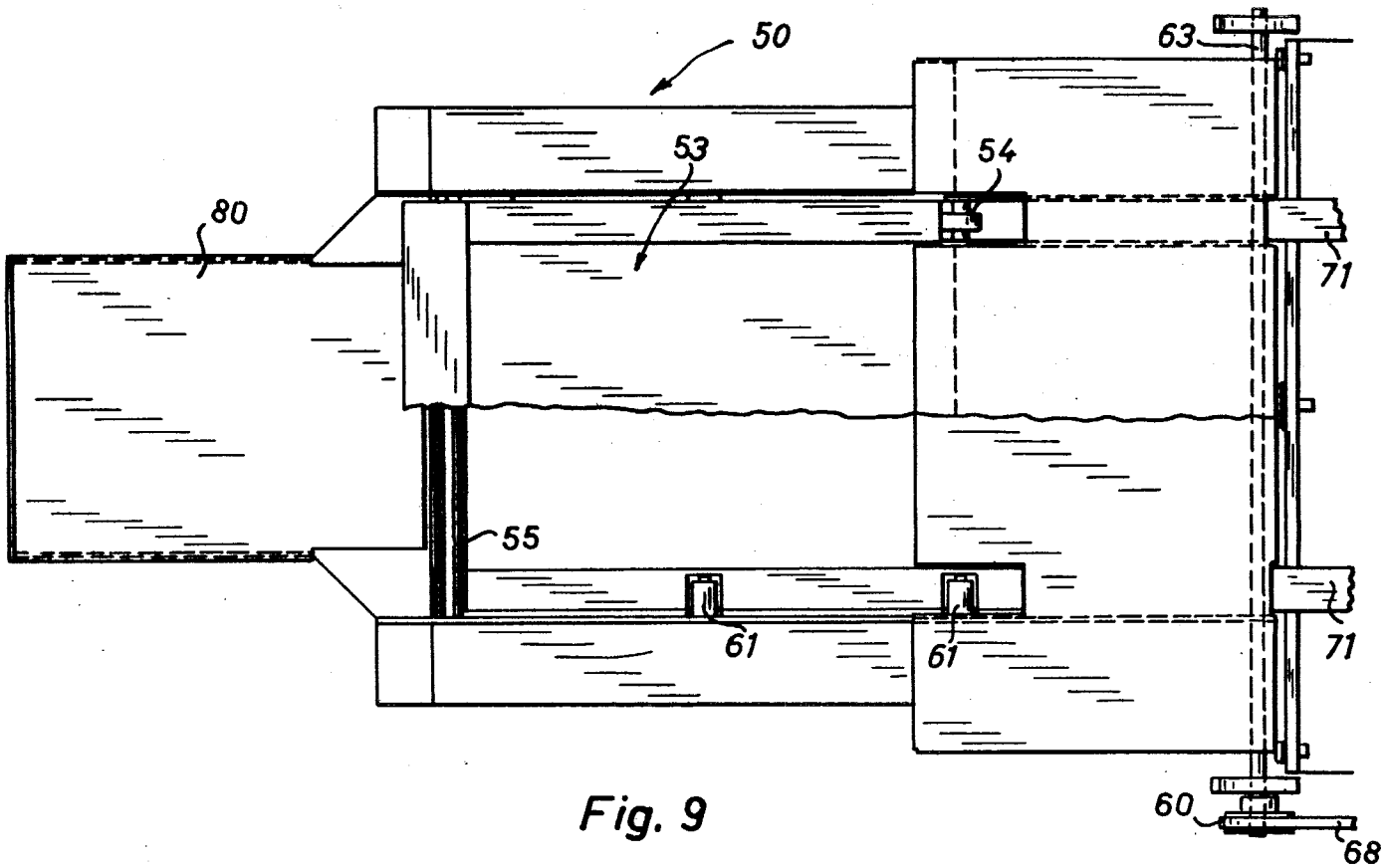

As shown in FIG. 9, sheet deflecting, flexible and arcuate belts 71, for example, of steel, are arranged at the upper end of the transport belts. These arcuate belts 71 deflect the sheets 41 to bring these sheets into the effective range of the transport rollers 11 shown, for example, in FIG. 2. Incidentally, FIG. 9 shows a top plan view of the sheet feed-in device 50, the side view of which is seen in FIG. 8.

FIG. 10 illustrates a sectional view through the cover 4 having secured to the undersides thereof a sheet hold down member 100 for slightly pressing the sheets 41 against the transport roller 11, whereby the sheets are properly guided in the direction of the arrow A (FIG. 2) without deviating from their transport path. Thus, it is assured, that the sheets 41 definitely reach the compartments 3 without clogging. As described, the transport rollers 11 are driven by gear belts 12 arranged laterally on one side of the collating apparatus in a respective housing section 26. The hold down member 100 comprises a housing 104 extending longitudinally in the transport direction and holding a plurality of friction reducing elements such as steel balls 102. The bottom of the housing 104 has cut-outs of sufficient size to permit the balls 102 to protrude from these cut-outs sufficiently to contact the sheets 41. Several of these hold down members or rails 100 may be arranged in parallel to each other across the cover 4 which is hinged and preferably transparent as mentioned. The cut-outs or openings in the bottom of the rail housing 104 are located so that the balls 102, preferably of steel, are positioned with their center of gravity substantially in alignment with the longitudinal axis of the hold down member 100 and also in alignment with the longitudinal axis of the transport rollers 11. The steel balls 102 have sufficient play inside the rail housing 104 so that their own gravity presses the balls sufficiently against the sheet 41 and thus against the respective driven transport roller 11, whereby the sheets 41 are properly entrained. Although, it is preferable to align the balls as just described, namely, above the longitudinal axis of the respective transport roller 11, it is also possible to align these balls, or rather, the openings in the bottom of the housing 104 differently, for example, so that a ball would be located between adjacent transport rollers, for instance, where heavier sheets are to be transported. The openings in the bottom of the housing 104 are of such a size, that the balls 102 are retained in the housing and there is sufficient play for the balls to accomodate sheets of different thickness.

FIG. 10*a* illustrates a modification of a hold down member 100' In this embodiment the rail housing 103 has lateral openings 106 and the rail housing 103 has a U-shaped cross sectional configuration which is inverted as shown. The openings 106 located in the legs of the housing 103 are so located and dimensioned that the balls 102 will protrude sufficiently below the lower edge of the legs so as to loosely contact the sheets 41 to be transported. The housing 103 is made of sufficiently spring elastic material, for example, sheet metal or plastics material so that the balls 102 are held rotatably in position while slightly pressing apart the legs of the housing 103. As illustrated in FIGS. 1 and 10, the transport rollers 11, the gates 10 and the drive means for the transport rollers 11 as well as for the gates 10 and the cover 4 are supported in a trough shaped body chassis 26 which forms a structural unit separable from the remainder of the apparatus. This feature of the invention facilitates the assembly and any maintenance work.

The gates 10 have cut-outs or spacings 51 in the area of the hold down members 100, 100' so that the gates may tilt upwardly adjacent to these hold down members.

FIG. 11 illustrates a sectional view along section line 11-11 in FIG. 8. Two tubular members 86 and 87 having a rectangular hollow cross section cooperate as a telescoping elements for the adjustment of the legs of the collating apparatus. The two members may be locked against each other by a set screw 89 or the like in the desired position. Thus, the height of the collating apparatus may be easily adapted to any particular requirements.

Although the invention has been described with reference to specific example embodiments, it will be appreciated, that it is intended, to cover all modifications and equivalents within the scope of the appended claims.

What is claimed is:

1. A sheet collating apparatus comprising frame means including a bottom portion and a top portion separable from said bottom portion, a plurality of collating compartments arranged in a row and having substantially upwardly facing openings, sheet advance means also supported by said frame means above said openings, sheet deflecting gate means each of which is arranged for cooperation with its respective collating compartment for deflecting a sheet into said respective collating compartment, actuating means connected to the sheet deflecting gate means, and control means operatively connected to said actuating means for sequentially positioning said sheet deflecting gate means into the path of an advancing sheet to sequentially place a sheet in each collating compartment, said control means comprising an electromagnet for each sheet deflecting gate means and circuit means including light switch means and electromagnets arranged to be sequentially activated by one sheet after another for sequentially tilting each sheet deflecting gate means into a sheet deflecting position, said sheet advance means comprising driven rollers (8, 11), drive shaft means (25) rotatably supporting said driven rollers in said frame means, positive drive means (12) operatively connected to said drive shaft means (25) of said driven rollers for positively rotating said driven rollers, said sheet deflecting gate means comprising tilting shafts (24) and gates (10) secured to said tilting shafts which are tiltably supported in said frame means intermediate adjacent drive shafts (25), said gates (10) being spaced from each other in the feed advance direction of the sheets so that gaps extend across the feed advance direction, said driven rollers extending in said gaps between adjacent sheet deflecting gates (10), said sheet deflecting gates (10) having a sheet passing position below a plane defined by said driven rollers (8, 11) whereby each gate substantially closes its respective collating compartment, and a sheet deflecting position, whereby the gate reaches with its free end above the plane defined by said driven rollers (8, 11) thereby opening the respective collating compartment, and further comprising cover means hinged to said frame means and positioned above said driven rollers (8, 11), said cover means comprising sheet hold down means extending in the feed advance direction of said sheets, said sheet hold down means comprising a plurality of rotatable hold down ball elements, means operatively securing said hold down ball elements to said hinged cover means in such positions that the hold down ball elements protrude downwardly through said gaps between said gates (10), said securing means including means for preventing said ball elements from falling downwardly out of said securing means when the securing means are tilted with said hinged cover means and wherein said collating compartments are arranged in said bottom portion of said frame means, said sheet deflecting gate means being arranged in said separable top portion of said frame means.

2. The apparatus of claim 1, wherein said hold down elements are positioned in alignment with the respective rollers below the cover means.

3. The apparatus of claim 1, wherein said cover means are transparent.

4. The apparatus of claim 1, wherein said circuit means comprise magnetically operable stepping switch means, means for resetting said stepping switch means, a single light source and a single photocell in said circuit means for sequentially stepping said stepping switch in response to placing a sheet into one compartment after another.

5. The apparatus of claim 4, wherein said resetting means comprise a counter which upon reaching a predetermined count resets the stepping switch to a starting position.

6. The apparatus of claim 1, further comprising an upwardly open end compartment adjacent to the last sheet deflecting gate means.

7. The apparatus of claim 1, wherein each sheet deflecting gate means comprises guide means projecting out of the plane of the respective gate means and toward the respective collating compartment.

8. The apparatus of claim 1, wherein said control means are arranged to respond to the complete passing of a sheet into a compartment so that the next sheet deflecting gate means will be raised in response to the passing of the trailing edge of a sheet into the compartment.

9. The apparatus of claim 1, wherein said sheet collating compartments have laterally open sides and are slanted relative to the vertical and toward the direction of sheet advance, each collating compartment further having a cut-out at its upper edge, said cut-outs being in register with each other so that a light beam may pass through said cut-outs below said sheet advance means.

10. The apparatus of claim 1, wherein said securing means for said sheet hold down ball elements comprise elongated housing means secured to said hinged cover means, said ball elements being rotatably supported in said elongated housing means, said housing means having a bottom facing a sheet and opening means in said bottom, said ball elements being held in said elongated housing means so as to protrude downwardly through said opening means.

11. The apparatus of claim 1, further comprising sheet supply means comprising a plurality of transport conveyor means and horizontal hinge means operatively connecting said sheet supply means to said collating apparatus.

12. The apparatus of claim 11, wherein said transport conveyor means of said sheet supply means comprise platform means and first endless conveyor belt means running around said platform means, as well as drive means for said first endless conveyor belt means operatively connected to sheet advance means, whereby said first endless conveyor belt means are positively driven for feeding sheets into said collating apparatus, said sheet advance means further comprising second conveyor belt means operatively arranged above said first conveyor belt means and above said platform in such a position that sheets are entrained between the cooperating conveyor belt means.

13. The apparatus of claim 1, wherein said frame means comprise telescoping leg members, whereby the height of said frame means is adjustable.

14. The apparatus of claim 1, further comprising body means separable from said frame means, said body means supporting said sheet advance rollers, said roller drive means, said sheet deflecting gate means, said gate actuating means, as well as said hinged cover means.

15. A sheet collating apparatus comprising frame means, a plurality of collating compartments arranged in a row and having substantially upwardly facing openings, sheet advance means supported in said frame means above said openings and comprising a plurality of horizontal parallel spaced apart first shafts (25) rotatably mounted in said frame means above said compartments, drive means (12) outside of said frame means for positively rotating said first shafts (25), and a plurality of axially spaced apart rollers (8, 11) mounted for rotation on each of said first shafts (25), sheet deflecting gate means (10, 24) each of which is arranged for cooperating with a respective separate collating compartment (3) for deflecting a sheet into said respective collating compartment, said sheet deflecting gate means comprising a plurality of second shafts (24) rotatably supported in said frame means in parallel to said first shafts (25) and below the plane defined by the top of said rollers (8, 11) on said first shafts (25), at least one gate (10) rigidly secured to each second shaft (24) for tilting the gates (10) which are aligned with the respective space between rollers on said first shafts (25), actuating means outside of said frame means for rotating said second shafts (24) between first positions at which said gates are substantially horizontal, and second positions at which separate ones of said gates are rotated with an edge extending above said rollers to deflect sheets downwardly into the respective compartments, and sheet deflectors (40) on the bottom surface of each gate for smoothly directing sheets (41) downwardly into the respective compartments, said sheet deflectors (40) being formed in said gates, control means operatively connected to said actuating means for sequentially positioning said sheet deflecting gates (10) into the path of advancing sheets to sequentially place sheets in said collating compartments, said control means comprising an electromagnet for each sheet deflecting means and circuit means including light switch means and electromagnets arranged to be sequentially activated by one sheet after another for sequentially tilting each sheet deflecting gate means into a sheet deflecting position, said light switch means being mounted to be responsive to the trailing edge of sheets entering said respective compartments, cover means rotatably mounted to said frame means above said rollers (8, 11), whereby sheets advancing in said apparatus are directed between said rollers and said cover means, and sheet hold down means arranged for cooperation with said positively driven rollers (8, 11), said sheet hold down means comprising elongated housing means, ball means rotatably supported in said elongated housing means, said housing means having a bottom facing a sheet and opening means in said bottom, said ball means being held in said elongated housing means so as to protrude downwardly through said opening means, said sheet deflecting gate means comprising gaps therein in register with said opening means in said housing bottom, whereby said ball means may contact a sheet in a hold down manner, and means preventing said ball means from falling downwardly out of said housing bottom.

16. The apparatus of claim 15, wherein said shaft rotating means are arranged on one side of said frame means and wherein said electromagnets are arranged on the other side of said frame means.

17. The apparatus of claim 1, further comprising a sheet supply and feeding means for feeding sheets to said collating apparatus comprising support means, first roller means rotatably secured to the ends of the support means, first endless conveyor belt means supported by said roller means and running around said support means, means operatively connecting one of said first roller means to said frame means of said collating apparatus, whereby said support means are tiltable up and down along with the first endless conveyor belt means, second conveyor means and second roller means also supported by said frame means, said second endless conveyor means having at least one section extending substantially in parallel to said first endless conveyor belt means to form a sheet advancing gap between said first and second conveyor belt means, said apparatus further comprising position adjustment means operatively interposed between said frame means and said support means for adjusting the angular position of said conveyor belt means relative to said frame means.

18. The apparatus of claim 17, wherein said second conveyor means comprise two endless conveyor belts, one of which is tiltable relative to the other to form a funnel type entrance with said first conveyor means.

19. The apparatus of claim 15, further comprising a sheet supply and feeding means for feeding sheets to said collating apparatus comprising support means, first roller means rotatably secured to the ends of the support means, first endless conveyor belt means supported by said roller means and running around said support means, means operatively connecting one of said first roller means to said frame means of said collating apparatus, whereby said support means are tiltable up and down along with the first endless conveyor belt means, second conveyor means and second roller means also supported by said frame means, said second endless conveyor means having at least one section extending substantially in parallel to said first endless conveyor belt means to form a sheet advancing gap between said first and second conveyor belt means, said apparatus further comprising position adjustment means operatively interposed between said frame means and said support means for adjusting the angular position of said conveyor belt means relative to said frame means.

20. The apparatus of claim 19, wherein said second conveyor means comprise two endless conveyor belts, one of which is tiltable relative to the other to form a funnel type entrance with said first conveyor means.

* * * * *